US011536294B1

(12) United States Patent
Zhu

(10) Patent No.: US 11,536,294 B1
(45) Date of Patent: Dec. 27, 2022

(54) FOLDABLE PORTABLE FAN

(71) Applicant: Shenzhen Chinaunion Technology Co., Ltd., Shenzhen (CN)

(72) Inventor: Xueping Zhu, Rucheng county (CN)

( * ) Notice: Subject to any disclaimer, the term of this patent is extended or adjusted under 35 U.S.C. 154(b) by 0 days.

(21) Appl. No.: 17/648,430

(22) Filed: Jan. 20, 2022

(51) Int. Cl.

| | |
|---|---|
| ***F04D 29/64*** | (2006.01) |
| ***F04D 29/52*** | (2006.01) |
| ***F04D 29/046*** | (2006.01) |
| ***F04D 25/08*** | (2006.01) |
| ***F04D 25/06*** | (2006.01) |
| ***F04D 29/42*** | (2006.01) |
| ***F04D 19/00*** | (2006.01) |

(52) U.S. Cl.
CPC ..... *F04D 29/646* (2013.01); *F04D 19/002* (2013.01); *F04D 25/0673* (2013.01); *F04D 25/08* (2013.01); *F04D 29/046* (2013.01); *F04D 29/4253* (2013.01); *F04D 29/522* (2013.01)

(58) Field of Classification Search
CPC ..... F04D 19/002; F04D 25/0613; F04D 25/0673; F04D 25/08; F04D 25/105; F04D 29/046; F04D 29/522; F04D 29/4253; F04D 29/601; F04D 29/646; F16C 11/04; F16C 11/045; F16M 11/04; F16M 11/08; F16M 11/10; F16M 2200/08
USPC ..... 417/246, 247 R; 248/185.1, 188.1, 188.7
See application file for complete search history.

(56) References Cited

U.S. PATENT DOCUMENTS

| | | | | |
|---|---|---|---|---|
| 4,850,804 | A * | 7/1989 | Huang | F16M 13/022 416/246 |
| 4,927,120 | A * | 5/1990 | Wang | F16M 11/10 248/676 |
| 6,213,716 | B1 | 4/2001 | Bucher et al. | |
| 8,734,109 | B2 | 5/2014 | He et al. | |
| 2004/0037704 | A1* | 2/2004 | Cichetti, Sr. | F16M 11/10 416/246 |
| 2011/0071579 | A1* | 3/2011 | Reach, Jr. | A61B 17/0401 411/360 |
| 2011/0268567 | A1* | 11/2011 | Ching | F04D 25/08 415/213.1 |
| 2012/0087812 | A1 | 4/2012 | Greenberg | |
| 2013/0108481 | A1* | 5/2013 | Hoye | F04D 25/084 417/234 |
| 2016/0327201 | A1* | 11/2016 | He | F16M 11/38 |

* cited by examiner

*Primary Examiner* — Devon C Kramer
*Assistant Examiner* — Joseph S. Herrmann

(57) ABSTRACT

The invention is about a foldable portable fan, which relates to the technical field of a fan, including an entity; the bottom of the entity is fixedly arranged with a connecting part, the connecting part is connected with a rotating part, one side of the rotating part is connected with a bolt, one end of the bolt is connected with a bolt column; the fan can conveniently connect the entity and the base together by setting a connecting part, a rotating part, a bolt and a bolt column, avoiding the use of screws, and the connection is very convenient; in addition, the entity can be folded between the base, which can save packaging materials, occupy less transportation space and save costs in logistics packaging; and the entity can be matched with different bases, thus providing higher selectivity and more flexible sale.

1 Claim, 6 Drawing Sheets

FOLDABLE PORTABLE FAN

FIELD OF THE INVENTION

The utility model relates to the technical field of fans, in particular to a foldable portable fan.

BACKGROUND OF THE RELATED ART

As a kind of diminutive fan, portable fan has been widely used. Because of its small size, and low noise, it is very popular with young people. However, the existing portable fan, because of its screw connection between the base and the fan entity, is not convenient to use; especially, with the development of information technology, online shopping is very popular, and the existing folding fan base and fan entity cannot be folded, hence the packaging materials will be wasted in logistics packaging, thus will occupy a large transportation space, and the costs will be relatively high.

In addition, the existing portable fan is generally only equipped with one base, its selectivity is not high, that is to say, users cannot choose different bases, even if there are different bases, the connection between the base and the fan entity realized by screws makes replacement of the base not convenient.

SUMMARY OF THE INVENTION

The utility model aims to provide a foldable portable fan to solve the problems raised in the background technology.

To achieve the above purposes, the utility model provides the following technical scheme: a foldable portable fan, including an entity; the bottom of the entity is fixedly arranged with a connecting part, the connecting part is connected with a rotating part, one side of the rotating part is connected with a bolt, one end of the bolt is connected with a bolt column, the one end of the bolt and the rotating part is fixedly installed with a bulge, the bottom of the rotating part is connected with a base.

Preferably, the middle of the base is provided with a socket hole, and the bottom of the rotating part is fixedly installed with an extension part matching the socket hole, and the edge of the extension part is provided with a bulge.

Preferably, the base is an "H" shaped structure, and the socket hole is situated at the center of gravity of the "H" shaped structure base.

Preferably, the base is a clamp, the clamp comprises the upper clamp body and the lower clamp body, the upper clamp body and the lower clamp body is connected by the hinge pin, and the outer part of the hinge pin is provided with a spring;

The upper end of the upper clamp body is provided with a socket hole connected with the extension part.

Preferably, the upper end of the base is provided with a mounting port, the mounting port is installed with a bearing, the rotating part at the bottom of the extension part is inserted in the inner ring of the bearing;

The inner part of the base is also fixedly installed with a motor, the output end of the motor is in contact with the inner ring of the bearing, rotating the inner ring of the bearing, and the inner part of the base is also installed with a battery for power supply to the motor.

Preferably, the base comprises an upper cross plate and a lower cross plate, and the center of the upper cross plate and the lower cross plate is inserted together, and can rotate each other between the two.

Preferably, the middle of the upper cross plate is provided with a socket hole, the middle of the lower cross plate is fixedly installed with an upward convex socket shaft, the lateral edge of the socket shaft is provided with a convex, the bottom of the lower cross plate is connected with a hinge pin.

Preferably, the rotating part is arranged on the upper end of the base, and the base is provided with a knob and a knob PCB board.

Preferably, the bottom of the entity is fixedly arranged with a connecting part, and the inserting part is directly connected with the inner ring of the bearing.

Compared with the existing technology, the utility model has the following beneficial effects:

The utility model can conveniently connect the entity and the base together by setting a connecting part, a rotating part, a bolt and a bolt column, avoiding the use of screws, and the connection is very convenient; in addition, the entity can be folded between the base, which can save packaging materials, occupy less transportation space and save costs in logistics packaging.

The entity can be matched with different bases, thus providing higher selectivity and more flexible sale.

Figure 1:
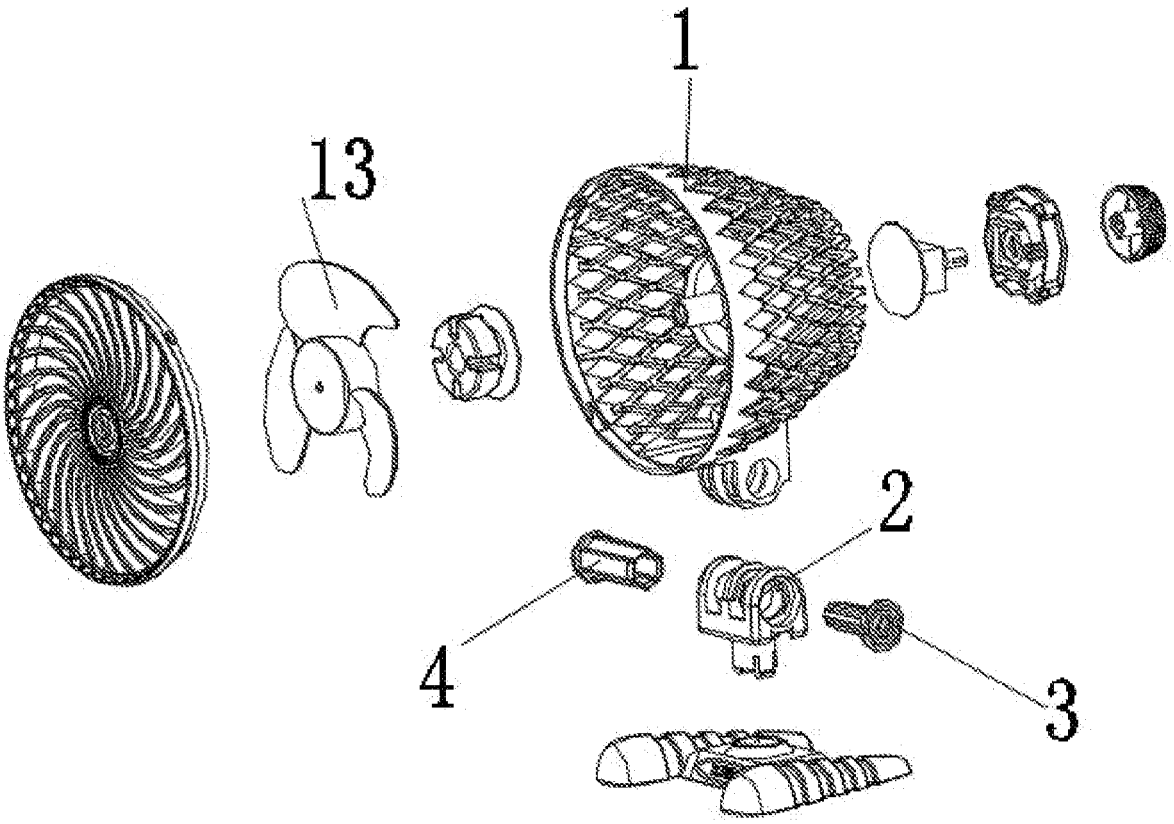
FIG. 1 is a schematic diagram of embodiment 1 of the utility model.

In the drawing: 1. entity; 2. rotating part; 3. bolt column; 4. bolt; 5. upper clamp body; 6. spring; 7. lower clamp body; 8. upper cross plate; 9. lower cross plate; 10. hinge pin; 11. motor; 12. batteries; 13. Blades.

DETAILED DESCRIPTION OF THE PREFERRED EMBODIMENTS

The technical scheme of the embodiment of the utility model will be described clearly and completely below in combination with the attached drawings of the embodiment of the utility model; apparently, the described embodiments are only one part of the embodiments of the utility model rather than all of the embodiments. All other embodiments based on the embodiments of the utility model and obtained by those of ordinary skill in this technical field without creative design belong to the protection scope of the utility model.

Embodiment 1

Figure 2:
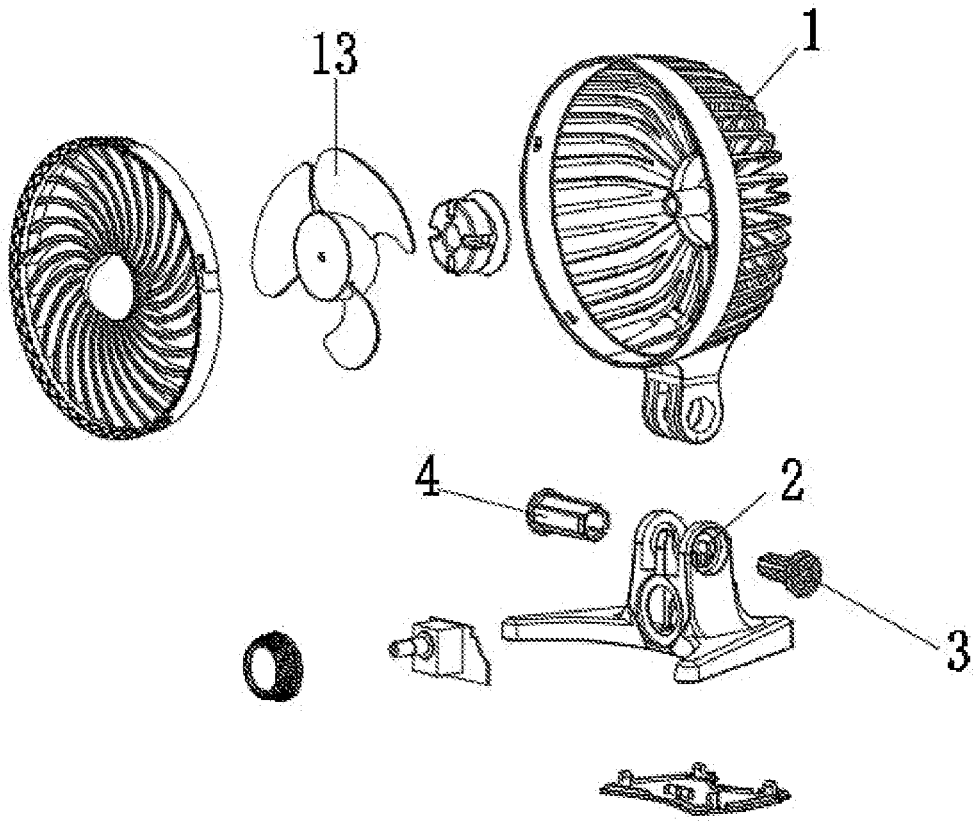
FIG. 2 is a schematic diagram of embodiment 2 of the utility model.

Please refer to FIG. 1-2. The embodiment provides a foldable portable fan, including entity 1, and entity 1 is composed of shell, blade 13, motor, knob and knob PCB board. The motor is fixed in the center of the shell, blade 13 is fixedly connected with the output shaft of the motor, external wires power the motor, and the knob is arranged in the back of the outer shell, the knob and the knob PCB board as the motor control switch, can be used to control the motor's working state.

When using the fan, users need to turn the knob, so that external power could be supplied to the motor, then the motor can rotate the fan blade 13, so as to achieve the work of the fan.

In this embodiment, in order to facilitate the use and storage of the fan and save the placing space of the fan, the bottom of the entity 1 is fixedly provided with a connecting part, the connecting part is plugged with a rotating part 2, and the bottom of the rotating part 2 is plugged with a base.

One side of the rotating part 2 is connected with the bolt 4, the bolt 4 is located in the inner part of the connecting part and the rotating part 2, and the connecting part and the rotating part 2 are connected together, the connecting part and the rotating part 2 can rotate on the outside of the bolt 4, so as to realize the folding between the entity 1 and the base.

One end of the bolt 4 is connected with the bolt column 3, and one end of the bolt 4 and the rotating part 2 is fixedly installed with a bulge.

When connecting, firstly, connecting part and rotating part 2 shall be connected together, and then plug bolt 4 from one side of the rotating part 2 into the inner side of connecting part and rotating part 2, finally plug the bolt column 3 from one end of the bolt 4 into the inner side of bolt column 3.

The bolt column 3 is a prism structure, and the edges and corners of the prism are set to open, when the bolt 4 is inserted, the bolt 4 can be deformed to facilitate the insertion of the bolt 4.

The bolt column 3 is inserted in the middle of the bolt 4, which plays a role in fixing the shape of the bolt 4, so as to avoid one end of the bolt 4 springing inwards when being put on stress, so that the bolt 4 and the connecting part and the rotating part 2 have a better connection effect, and avoid the falling off of bolt 4.

One end of bolt 4 and bolt column 3 is fixedly installed with a retaining ring, which plays a limiting role on bolt 4 and bolt column 3 when used, and avoid the use of screws, making the installation more convenient and fast.

And the adjustment of angle is also convenient: users just need to rotate the entity, so that the adjustment of the angle of the entity 1 can be achieved by connecting outside of the bolt 4 with any different edges and corners of the connecting part and rotating part.

As shown in FIG. 1, the base is an "H" shaped structure, and the socket hole is situated at the center of gravity of the "H" shaped structure base, the middle of the base is provided with a socket hole, and the socket hole is arranged in the center of gravity of the "H" shaped structure base, and the bottom of the rotating part 2 is fixedly installed with an extension matching the socket hole, and the edge of the extension part is provided with a bulge.

When installing, insert the rotating part directly into the socket of the base, which is simple and convenient.

Embodiment 2

As shown in FIG. 2, the rotating part 2 is arranged at the top of the base, the connecting part of entity 1 plug on the rotating part 2 directly, by the same token, connecting part and rotating part 2 are connected through the bolt 4 and bolt column 3; in the implementation of this case, the battery is not set, but the external power supply circuit is used, knob and knob PCB board are installed on the base, and knob and knob PCB board are used to control the working status of the fan.

In this embodiment, the entity 1 and the base are directly connected by rotating part and connecting part, which also avoids the use of screw connection and is relatively convenient.

Embodiment 3

Figure 3:
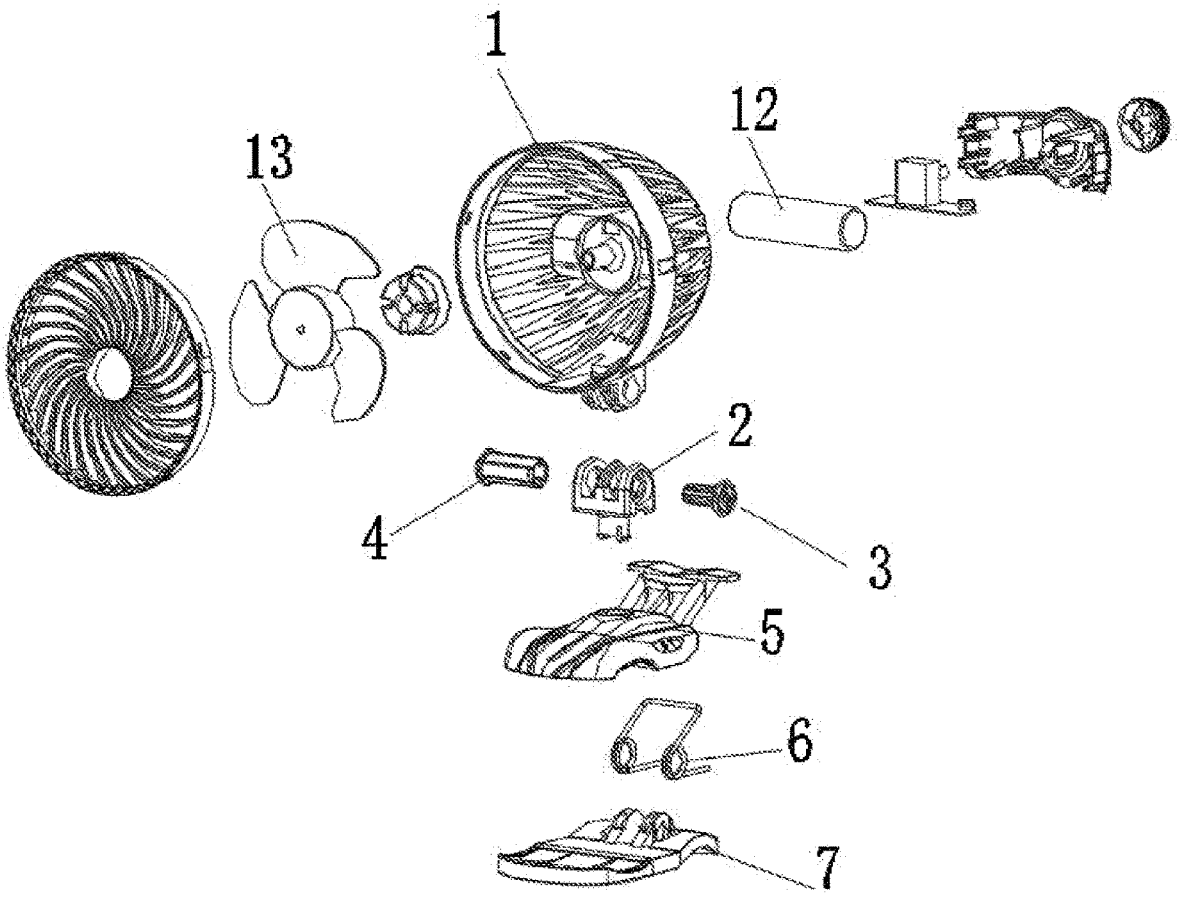
FIG. 3 is a schematic diagram of embodiment 3 of the utility model.

Please refer to FIG. 3. Entity 1 is composed of shell, blade 13, motor, knob and knob PCB board. The motor is fixed in the center of the shell, blade 13 is fixedly connected with the output shaft of the motor, battery 12 is mounted inside the rear of the shell and provides power to the motor; the knob is arranged in the back of the outer shell, the knob and the knob PCB board as the motor control switch, can be used to control the motor's working state.

The base is a clamp, the clamp comprises the upper clamp body 5 and the lower clamp body 7, the upper clamp body 5 and the lower clamp body 7 are connected by the hinge pin, and the outer part of the hinge pin is provided with a spring 6;

The upper end of the upper clamp body 5 is provided with a plug hole connected with the extension part, which can be directly connected with the extension part of the rotating part 2. Clamps can be used in different locations and environments, and can be clamped when used, such as to the edge of the table, the edge of the bedside table, etc. thus can be placed more stable, and more convenient to use. The fan is small, preventing the fan from falling due to accidental collision.

Embodiment 4

Figure 4:
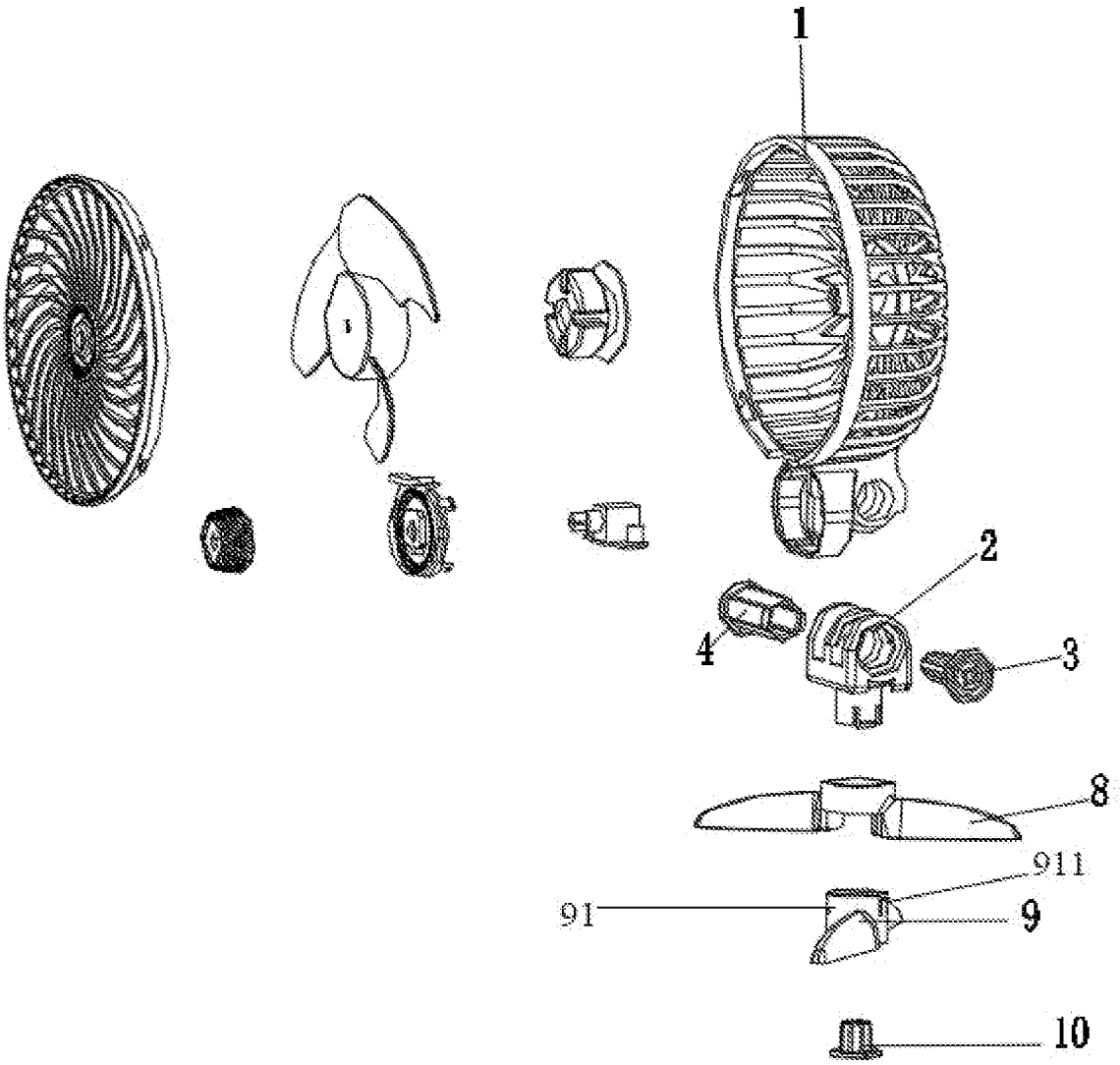
FIG. 4 is a schematic diagram of embodiment 4 of the utility model.

As shown in FIG. 4, the base includes an upper cross plate 8 and a lower cross plate 9 in a cross arrangement, and the center of the upper cross plate 8 and the lower cross plate 9 are inserted together and can rotate each other between the two.

The upper cross plate 8 and the lower cross plate 9 can be directly connected by hollow rotating shaft.

The upper end of the rotating shaft is an open structure; the rotating shaft is directly inserted upward from the bottom of the upper cross plate 8 and the lower cross plate 9, and the extension part of the rotating part 2 is directly inserted into the rotating shaft; the opening and closing angle between the upper cross plate 8 and the lower cross plate 9 can be adjusted by rotation; when placing fans, users can adjust the opening and closing angles according to different tables to keep the fans stable.

In addition, the upper cross plate 8 and the lower cross plate 9 can be rotated together and folded together with the entity 1 to reduce its volume, therefore, in long-distance transportation, especially by mail, more costs can be saved on packaging and transportation.

In further embodiments, the upper cross plate 8 and the lower cross plate 9 may be connected in other ways, for example, the middle of the upper cross plate 8 is provided with a socket hole, the middle of the lower cross plate 9 is fixedly installed with an upward convex socket shaft 91, the upper end of the socket shaft is an open structure, the socket shaft can be directly inserted in the internal socket hole, and the two cross plates can rotate relatively, and the size of the opening and closing angle between the two cross plates can be adjusted; the outer edge of the socket shaft 91 is provided with a convex 911, the convex 911 can prevent the lower cross plate 9 from falling off from the inside of the upper cross plate 8, the bottom of the lower cross plate 9 is connected with hinge pin 10; when the extension part of the rotating part 2 can be directly connected to the interior of the plug shaft of the cross plate 9, the hinge pin 10 can be connected to the interior of the extension part from the bottom of the lower cross plate 9, fixing the shape of the extension part, so as to avoid the edges of the extension part bouncing inwards.

In this embodiment, a knob and a knob PCB board are arranged at the bottom of the shell of entity 1.

Embodiment 5

Figure 5:
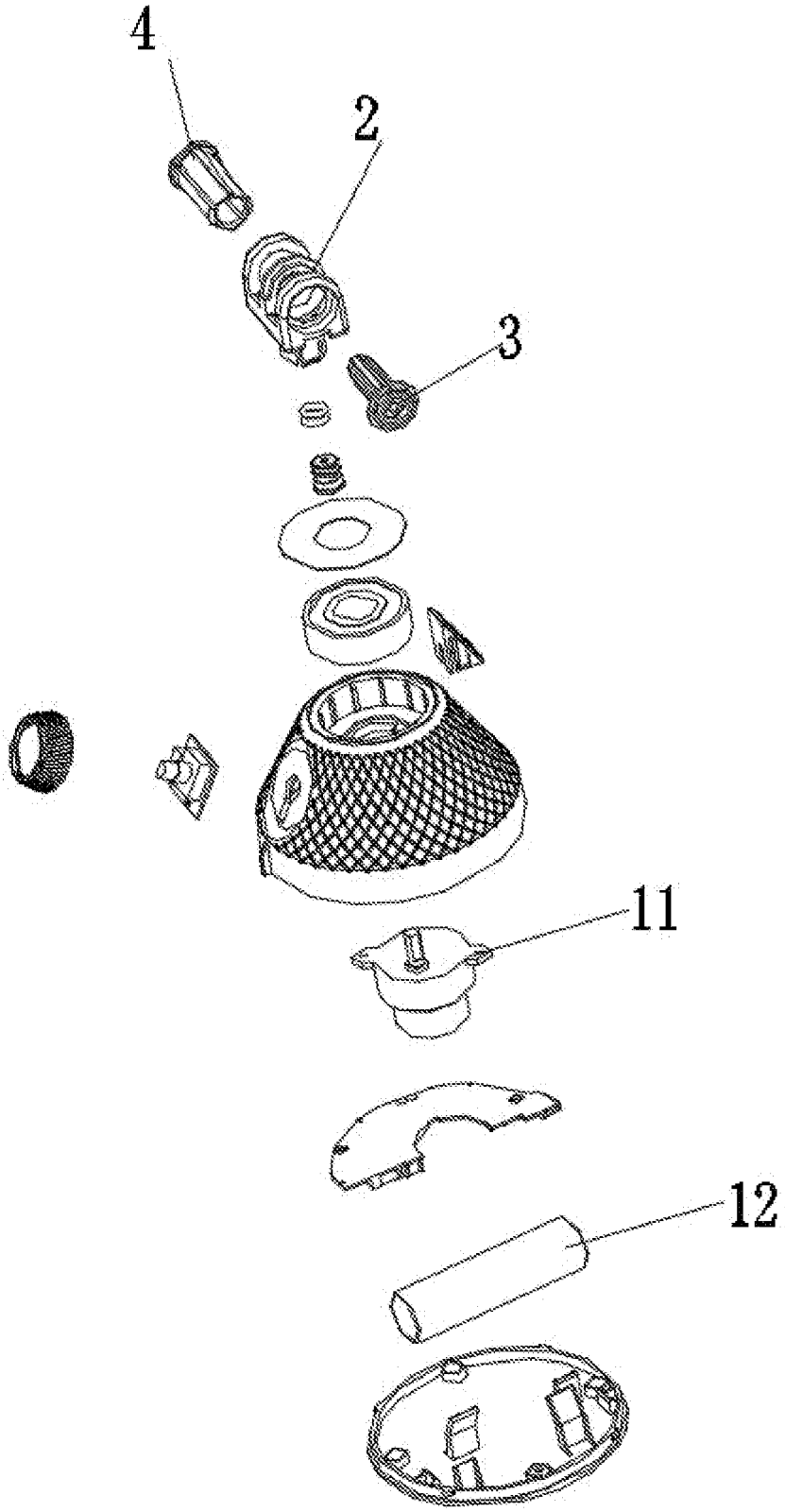
FIG. 5 is a schematic diagram of embodiment 5 of the utility model.

As shown in FIG. 5, the upper end of the base is provided with a mounting port, and the mounting port is installed with a bearing inside, and the extension part at the bottom of the rotating part 2 is inserted in the inner ring of the bearing; a motor 11 is fixedly installed inside the base, the output end of the motor 11 is in contact with the inner ring of the bearing and rotates with the inner ring of the bearing; there is also a battery 12 installed inside the base to supply power to the motor, the motor 11 can rotate with the fan entity 1 to realize the shaking of the head when the fan is working.

Moreover, in this embodiment, the head-shaking motor of the fan and the motor rotating with the fan blade are two motors, so the mechanical head-shaking mode of the fan is avoided, thus makes the volume of the fan smaller, and makes the fan more convenient to use and carry.

The invention can more conveniently connect the fan entity with the base by setting the connecting part, rotating part 2, bolt 4 and bolt column 3, especially in the purchase of fans: a fan entity can be equipped with multiple bases, providing higher selectivity; and the base and the fan entity can also be sold separately, which makes selling more flexible.

Embodiment 6

Figure 6:
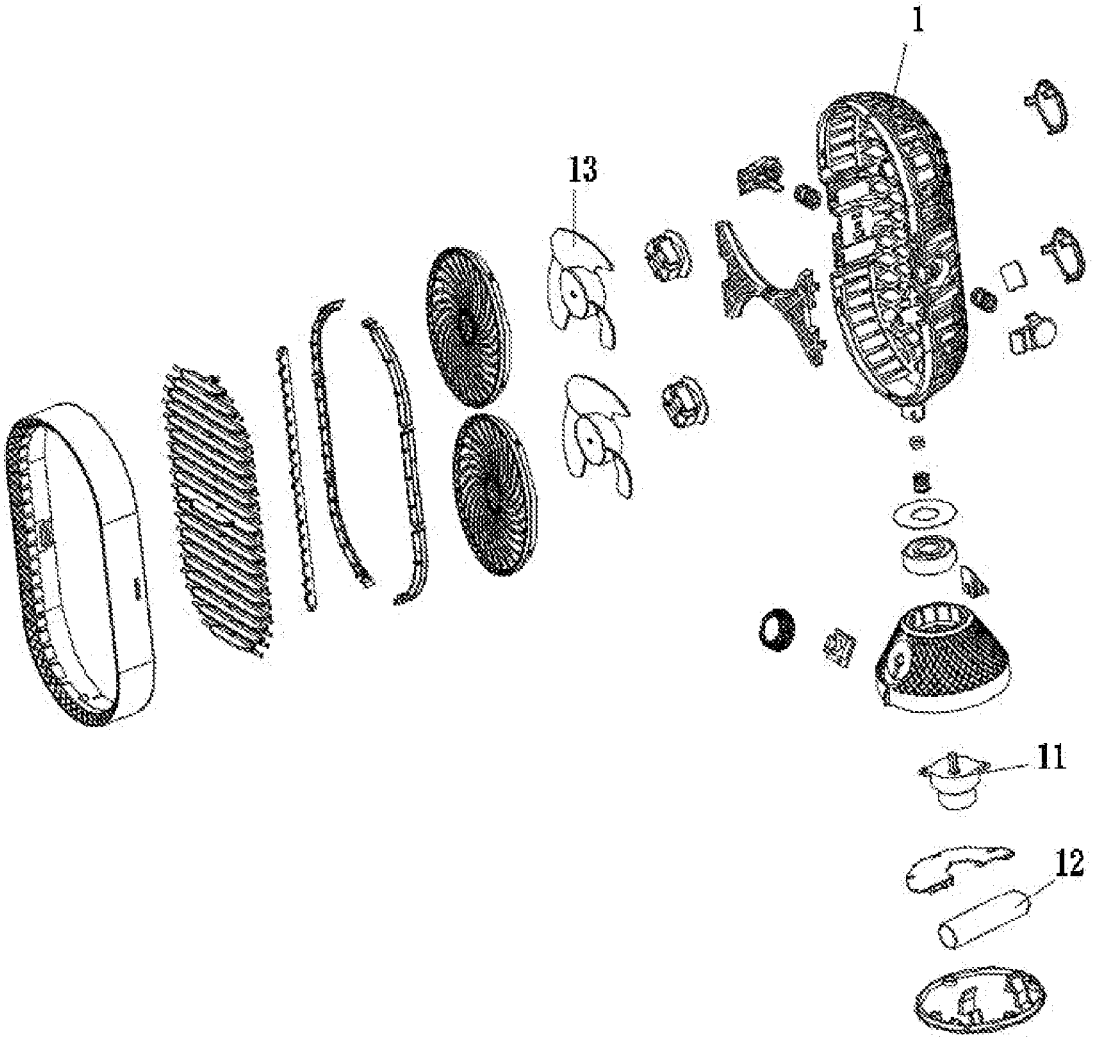
FIG. 6 is a schematic diagram of embodiment 6 of the utility model.

As shown in FIG. 6, the bottom of the entity 1 is fixedly provided with a connecting part, connecting part is directly connected with the inner ring of the bearing, the connecting part can be directly connected to the base without the connecting part, rotating part 2, bolt 4 and bolt column 3, so that the fan has two motors: one motor is used to rotate with the fan blade, and the other fan is used to rotate with the entity 1, which also can make the volume of the fan more smaller, more convenient to use and carry.

Although the embodiment of the utility model has been shown and described, for those of ordinary technicians in this field, without departing from the principles and spirits of the utility model, various changes, modifications, substitutions and variants of the embodiments can be made; and the scope of the utility model is defined by the attached claims and their equivalents.

I claim:

1. A foldable portable fan, comprising an entity (1);

a bottom of the entity (1) is fixedly arranged with a connecting part, the connecting part is connected with a rotating part (2);

one side of the rotating part (2) is connected with a bolt (4);

one end of the bolt (4) is connected with a bolt column (3);

a bottom of the rotating part (2) is connected with a base;

wherein a middle of the base is provided with a socket hole, and the bottom of the rotating part (2) is fixedly installed with an extension part matching the socket hole, and an edge of the extension part is provided with a bulge;

wherein the base comprises an upper cross plate (8) and a lower cross plate (9), and a center of the upper cross plate (8) and a center of the lower cross plate (9) are inserted together, and are capable of being rotated together;

wherein a middle of the upper cross plate (8) is provided with the socket hole; a middle of the lower cross plate (9) is fixedly installed with an upward convex socket shaft a lateral edge of the upward convex socket shaft is provided with a convex; a bottom of the lower cross plate (9) is connected with a hinge pin (10).

* * * * *